US005769165A

United States Patent [19]

Bross et al.

[11] Patent Number: 5,769,165

[45] Date of Patent: Jun. 23, 1998

[54] METHOD FOR INCREASING METHANE RECOVERY FROM A SUBTERRANEAN COAL FORMATION BY INJECTION OF TAIL GAS FROM A HYDROCARBON SYNTHESIS PROCESS

[75] Inventors: Stephen V. Bross, Sugar Land; Vu P. Dinh, Katy, both of Tex.

[73] Assignee: Vastar Resources Inc., Houston, Tex.

[21] Appl. No.: 594,700

[22] Filed: Jan. 31, 1996

[51] Int. Cl.[6] ..... E21B 43/17; E21B 43/24; E21B 43/34

[52] U.S. Cl. ..... 166/266; 166/267; 166/268; 166/272.1; 166/272.2; 166/263

[58] Field of Search ..... 166/263, 266, 166/267, 268, 271, 272, 303, 305.1

[56] References Cited

U.S. PATENT DOCUMENTS

| | | | |
|---|---|---|---|
| 4,043,395 | 8/1977 | Every et al. | 166/263 |
| 4,098,339 | 7/1978 | Weisz et al. | 166/268 X |
| 4,114,688 | 9/1978 | Terry | 166/266 X |
| 4,242,103 | 12/1980 | Rabo et al. | 166/267 X |
| 4,537,252 | 8/1985 | Puri et al. | 166/272 |
| 4,662,439 | 5/1987 | Puri et al. | 166/272 |
| 4,662,443 | 5/1987 | Puri et al. | 166/261 |
| 4,747,642 | 5/1988 | Gash et al. | 166/256 |
| 4,756,367 | 7/1988 | Puri et al. | 166/263 |
| 4,762,543 | 8/1988 | Pantermucehl et al. | 62/28 |
| 4,765,407 | 8/1988 | Yuvancic | 166/268 |
| 4,833,170 | 5/1989 | Agee | 518/703 |
| 4,883,122 | 11/1989 | Puri et al. | 166/263 |
| 4,913,237 | 4/1990 | Kutas | 166/308 |
| 4,973,453 | 11/1990 | Agee | 422/190 |
| 4,993,491 | 2/1991 | Palmer et al. | 166/280 |
| 5,014,785 | 5/1991 | Puri et al. | 166/263 |
| 5,014,788 | 5/1991 | Puri et al. | 166/280 |
| 5,048,328 | 9/1991 | Puri . | |
| 5,085,274 | 2/1992 | Puri et al. | 166/252 |
| 5,099,921 | 3/1992 | Puri et al. | 166/266 |
| 5,133,406 | 7/1992 | Puri | 166/266 |
| 5,332,036 | 7/1994 | Shirley et al. | 166/268 |
| 5,388,640 | 2/1995 | Puri et al. | 166/263 |
| 5,388,641 | 2/1995 | Yee et al. | 166/263 |
| 5,388,642 | 2/1995 | Puri et al. | 166/266 |
| 5,388,643 | 2/1995 | Yee et al. | 166/266 |
| 5,388,645 | 2/1995 | Puri et al. | 166/268 |
| 5,417,286 | 5/1995 | Puri et al. | 166/308 |
| 5,419,396 | 5/1995 | Palmer et al. | 166/250 |
| 5,439,054 | 8/1995 | Chaback et al. | 166/252 |
| 5,454,666 | 10/1995 | Chaback et al. | 405/52 |
| 5,494,108 | 2/1996 | Palmer et al. | 166/308 |
| 5,501,273 | 3/1996 | Puri | 166/252 |
| 5,566,755 | 10/1996 | Seidle et al. | 166/263 |

OTHER PUBLICATIONS

SPE 20732 paper entitled "Enhanced Coalbed Methane Recovery", R. Puri and D. Yee, presented at the 65th Annual Technical Conference and Exhibition of the Society of Petroleum Engineers, New Orleans, LA, Sep. 23–26, 1990.

"Multicomponent high–pressure adsorption equilibria on carbon substrates: theory and date", *Fluid Phase Equilibria,* 78 (1992) 99–137 pgs.; Elsevier Science Publishers, B.V., Amsterdam.

*Primary Examiner*—George A. Suchfield
*Attorney, Agent, or Firm*—F. Lindsey Scott

[57] ABSTRACT

A method for increasing the production of methane from a subterranean coal formation penetrated by an injection well and a production well by producing methane from the coal formation via the production well; passing a portion of the methane to a synthesis gas generation zone wherein at least a portion of the methane is reacted with an oxygen-containing gas to produce a mixture of carbon monoxide and hydrogen; passing a major portion of the mixture to a hydrocarbon synthesis zone wherein the carbon monoxide and hydrogen are reacted to produce heavier hydrocarbons and a tail gas comprising nitrogen and carbon dioxide; separating a major portion of the tail gas from the hydrocarbons and recovering the hydrocarbons as a product stream; injecting at least a portion of the tail gas into the coal formation through the injection well. The methane may be obtained from a single well or a plurality of wells operated to produce the methane by a huff and puff process.

19 Claims, 1 Drawing Sheet

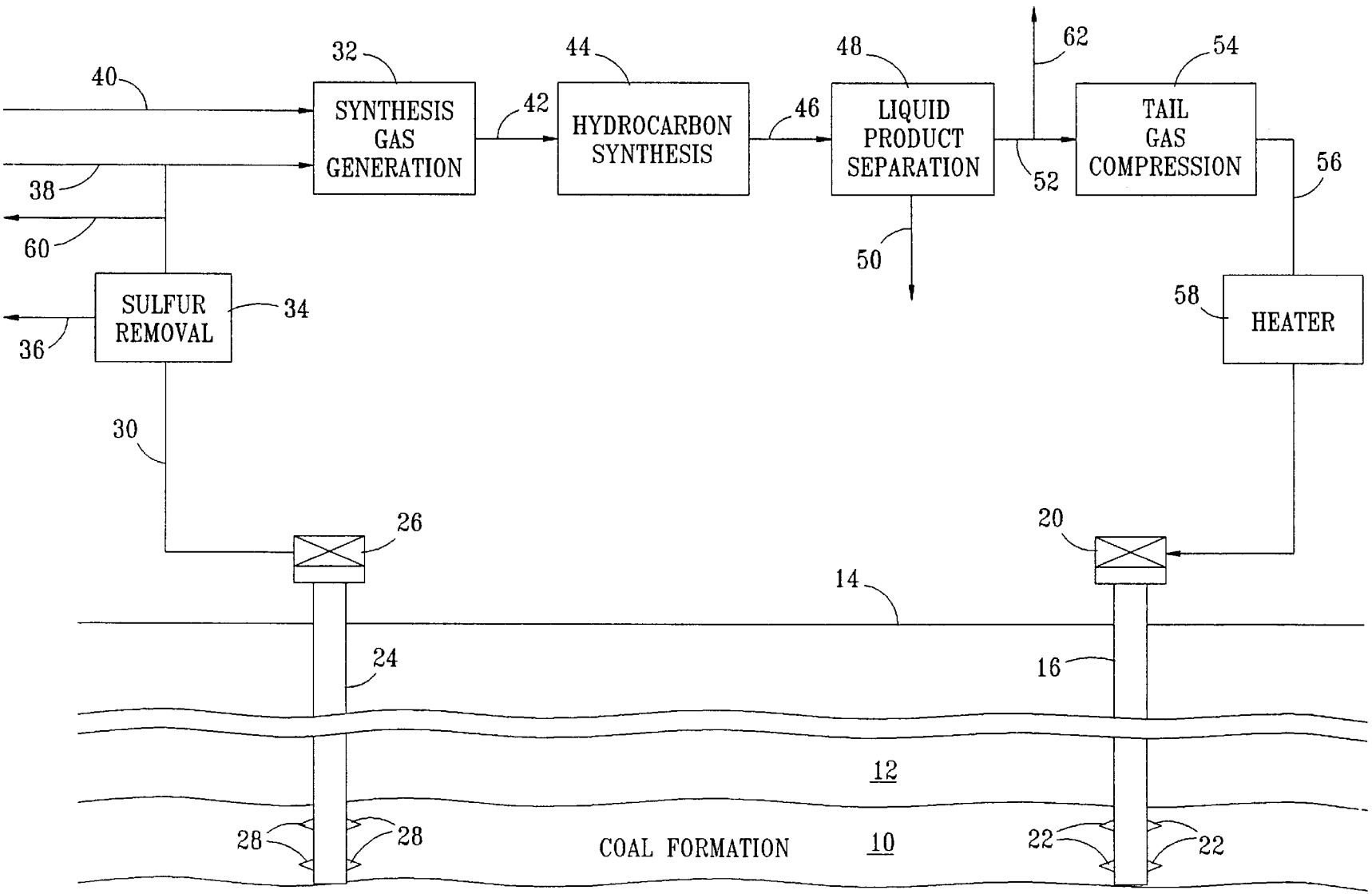
SYNTHESIS GAS GENERATION
HYDROCARBON SYNTHESIS
LIQUID PRODUCT SEPARATION
TAIL GAS COMPRESSION
HEATER
SULFUR REMOVAL
COAL FORMATION
10
12
14
16
20
22
24
26
28
30
32
34
36
38
40
42
44
46
48
50
52
54
56
58
60
62

METHOD FOR INCREASING METHANE RECOVERY FROM A SUBTERRANEAN COAL FORMATION BY INJECTION OF TAIL GAS FROM A HYDROCARBON SYNTHESIS PROCESS

BACKGROUND OF THE INVENTION

1. Field of the Invention

This invention relates to an improved method for removing methane from subterranean coal formations. More particularly, the present invention relates to a method for increasing the production of methane from a subterranean coal formation by the injection of a tail gas from a hydrocarbon synthesis process under conditions effective to increase the production of methane from the coal formation.

2. Brief Description of the Prior Art

Substantial quantities of methane gas are found in subterranean coal formations.

A variety of processes have been used in attempts to recover the methane from the coal formations more efficiently.

The simplest process is the pressure reduction process wherein a borehole is drilled into a coal formation from the surface and methane is withdrawn from the borehole by reducing the pressure to cause methane to be desorbed from and flow from the coal formation into the borehole and to the surface. This method is not efficient because coal formations are generally not extremely porous and the methane is generally not found in the pores of the coal formation but is absorbed onto the coal. While methane can be produced from coal formations by this process, the production of methane is relatively slow.

Another method for recovering methane from coal formations is injection of a gas, such as carbon dioxide ($CO_2$), having a higher affinity for coal than the absorbed methane into the coal formation and thereby establishing a competitive absorption-desorption process. In such processes, the $CO_2$ displaces the methane from the coal so that the methane is freed and can flow to a nearby wellbore for recovery. Large volumes of $CO_2$ are required in such processes and eventually $CO_2$ may be produced with the methane.

Gases which have a lower affinity for coal than $CO_2$ can also be injected to increase methane recovery. Gases such as nitrogen, argon, and other inert gases can be used, particularly when injected at pressures higher than the coal formation pressure, to cause methane to desorb from the coal as required to maintain the methane partial pressure in the atmosphere in the coal formation. This method also requires the use of large volumes of gas and may eventually result in the production of nitrogen or other inert gases with the methane. Such injection processes may be operable for long periods of time, i.e., possibly several years, before injected carbon dioxide or nitrogen or other inert gases are recovered with the methane.

Other gases such as hydrogen, carbon monoxide and light hydrocarbons containing less than 5 and preferably less than 3 carbon atoms are also considered beneficial as injection materials, especially when the gas injection is at relatively high temperature and high pressure.

Various processes for the recovery of methane from coal formations are shown in U.S. Pat. No. 4,756,367 issued Jul. 12, 1988 to Puri, et al.; U.S. Pat. No. 4,043,395 issued Aug. 23, 1977 to Every, et al.; U.S. Pat. No. 4,883,122 issued Nov. 28, 1989 to Puri, et al.; U.S. Pat. No. 4,913,237 issued Apr. 3, 1990 to Kutas; U.S. Pat. No. 4,993,491 issued Feb. 19, 1991 to Palmer, et al.; U.S. Pat. No. 5,014,785 issued May 14, 1991 to Puri, et al.; U.S. Pat. No. 5,048,328 issued Sep. 17, 1991 to Puri; U.S. Pat. No. 5,085,274 issued Feb. 4, 1992 to Puri, et al.; U.S. Pat. No. 5,099,921 issued Mar. 31, 1992 to Puri, et al.; U.S. Pat. No. 5,133,406 issued Jul. 28, 1992 to Puri; U.S. Pat. No. 5,332,036 issued Jul. 26, 1994 to Shirley, et al.; U.S. Pat. No. 5,388,640 issued Feb. 14, 1995 to Puri, et al.; U.S. Pat. No. 5,388,641 issued Feb. 14, 1995 to Yee, et al.; U.S. Pat. No. 5,388,642 issued Feb. 14, 1995 to Puri, et al.; and U.S. Pat. No. 5,388,643 issued Feb. 14, 1995 to Yee, et al., all of which are hereby incorporated in their entirety by reference.

In such processes, it is necessary to obtain large volumes of $CO_2$ or inert gas by either combusting fuel gas or the like with air to produce a de-oxygenated nitrogen stream, which may also contain $CO_2$, by removing oxygen from nitrogen or the like. In any event, the production of the large volumes of nitrogen or other inert gas or $CO_2$ requires the use of considerable fuel, energy and processing capacity. Further, the nitrogen, inert gas or $CO_2$ may break through the formation with the recovered methane long before the formation is depleted of methane, thereby resulting in a methane stream which is contaminated with nitrogen, inert gas or $CO_2$ which must be removed prior to sale of the methane.

Since the quantities of methane available in subterranean coal formations is vast and since it is desirable to produce the methane at the lowest cost, a continuing search has been directed to more economical methods for producing an injection gas for use in increasing the production of methane from such coal formations.

SUMMARY OF THE INVENTION

According to the present invention, the production of methane from a subterranean coal formation penetrated by at least one injection well and at least one production well is increased by a method comprising:

producing methane from the coal formation;

passing at least a portion of the methane to a synthesis gas generation zone wherein at least a major portion of the methane is reacted with an oxygen containing gas to produce a mixture of carbon monoxide and hydrogen;

passing at least a major portion of the mixture to a hydrocarbon synthesis zone wherein the carbon monoxide and hydrogen are reacted to produce heavier hydrocarbons and a tail gas comprising nitrogen and carbon dioxide;

separating at least a major portion of the tail gas from at least a major portion of the hydrocarbons and recovering the hydrocarbons as a product stream;

compressing at least a portion of the tail gas to a pressure suitable for injection into the coal formation; and injecting at least a portion of the tail gas into the coal formation.

The methane may also be obtained from a single well or a plurality of wells operated to produce the methane by a huff and puff process.

BRIEF DESCRIPTION OF THE DRAWINGS

The FIGURE is a schematic diagram of an embodiment of the process of the present invention.

DESCRIPTION OF THE PREFERRED EMBODIMENTS

In the FIGURE, the various pumps, compressors, valves and the like necessary to achieve the flows described are conventional and have not been shown.

A coal formation 10 containing methane is positioned beneath an overburden 12 and penetrated from a surface of the earth 14 by an injection well 16. The injection well 16 includes a wellhead 20 designed to regulate the flow of injected materials into the well 16 and through a plurality of perforations 22 into the coal formation 10. A production well 24 is positioned from the surface 14 through the overburden 12 and into the coal formation 10 at a spaced apart location. The production well 24 includes a wellhead 26 adapted to the recovery of methane and other gases from the well 24. The well 24, as shown, includes a plurality of perforations 28 into the coal formation 10 to facilitate the flow of methane and other gases from the coal formation 10 into and through the well 24 and the wellhead 26 to a line 30. Alternatively, an open hole (uncased) well could be used. At least a portion of the methane and possibly other associated gases flows through the line 30 to a synthesis gas generator 32. Optionally, a sulfur removal unit 34 is positioned in the line 30 to remove sulfur from the gaseous stream in the line 30. The recovered sulfur is removed through a line 36. The methane passed to the synthesis gas generator 32 may be diluted with an inert gas via a line 38, or if the gas stream is too lean, it may be enriched with a methane containing gas via the line 38. The stream in the line 30 is passed to the synthesis gas generator 32 where it is reacted with an oxygen-containing gas charged through a line 40. The synthesis gas mixture produced in the synthesis gas generator 32 comprises carbon monoxide and hydrogen in a hydrogen-to-carbon monoxide ratio from about 1.5 to about 3. The mixture may also include nitrogen and other inert gases, as well as water and carbon dioxide. While not shown, this stream may be treated to remove at least a portion of the carbon dioxide and water and sulfur if necessary prior to charging it to a hydrocarbon synthesis unit 44 via a line 42. The hydrocarbon synthesis unit 44 is a reaction zone where the carbon monoxide is combined with the hydrogen to produce heavier hydrocarbons. Processes of the type generally referred to as Fischer-Tropsch processes are suitable for use as the hydrocarbon synthesis zone. The resulting stream comprising heavier hydrocarbons, lighter hydrocarbons and some unreacted carbon monoxide and hydrogen plus carbon dioxide and water are passed through a line 46 to a liquid products separation zone 48. In the liquid products separation zone 48, the gaseous mixture is cooled and liquid hydrocarbons are recovered through a line 50. Desirably, the gaseous mixture is not cooled to an extremely low temperature. Preferably, the cooling is to an ambient temperature or about 70° F. The cooling can be accomplished by any suitable means known to those skilled in the art. The resulting gaseous mixture less the liquid hydrocarbons is recovered through a line 52 and passed to a tail gas compression zone 54. In the tail gas compression zone 54, the tail gas is compressed with a resulting increase in the temperature and passed through a line 56 back to the injection well 16. Optionally, a heater 58 may be positioned in the line 56 to further increase the temperature of the gaseous mixture. Since both the synthesis gas generation and hydrocarbon synthesis processes are exothermic, the heat exchange in the heater 58 may be with streams from these processes.

The tail gas mixture, as previously discussed, typically contains nitrogen and other inert gases introduced into the process through the line 30, the line 38 or the line 40. The resulting tail gas mixture typically contains nitrogen, carbon monoxide, carbon dioxide, water vapor and, in most instances, some light hydrocarbons containing less than about three carbon atoms. This mixture is injected at a selected pressure and a selected temperature back into the coal formation 10 as discussed previously. The temperature may be elevated to any selected level compatible with the capabilities of the injection well 16. The pressure is desirably less than fracturing pressure for the coal formation 10. Pressures greater than fracturing pressure may be used so long as the injection and production wells are sufficiently spaced so that the fractures do not extend from the injection well to the production well. Fractures which do not extend to the production well can be beneficial in more widely distributing the injection gas throughout the coal formation 10.

The synthesis gas generation, hydrocarbon synthesis and liquid product separation are considered to be well known to those skilled in the art and desirably comprise processes of the type generally referred to as Fischer-Tropsch processes. Examples of such processes are shown in U.S. Pat. No. 4,833,170 issued May 23, 1989 to Agee and U.S. Pat. No. 4,973,453 issued Nov. 27, 1990 to Agee. These patents are hereby incorporated in their entirety by reference. These processes generally utilize a noncatalytic sub-stoichiometric, partial oxidation of light hydrocarbons to produce synthesis gas or steam reforming of methane or a combination of partial oxidation and steam reforming known as autothermal reforming. These processes are considered to be well known to those skilled in the art and are also readily adjustable by those skilled in the art to vary the ratio of hydrogen to carbon monoxide produced from the process. Not only is the adjustment of the ratio of hydrogen to carbon monoxide produced in the process known to those skilled in the art, it is also known to those skilled in the art to further adjust the ratio of these materials by a water-gas shift reaction followed by removal of $CO_2$ and the like. The hydrocarbon synthesis reaction zone is also considered to be known to those skilled in the art as described in the foregoing patents. Such synthesis processes generally use a catalyst which may comprise cobalt supported on silica, alumina or silica-alumina material in an amount from about 5 to about 50 parts by weight of cobalt per hundred parts by weight of support material or another suitable catalyst. The catalyst may also contain from 0.1 to 5 parts by weight of potassium per hundred parts by weight of support material as a promoter. Other catalysts may also be used. The separation of the liquid products is a conventional cooling and liquid separation step as well known to those skilled in the art.

Other hydrocarbon synthesis processes can be used which involve the use of methanol as an intermediate and the like. Such processes are also considered to be well known to those skilled in the art.

When methane in a substantially pure state is produced from the coal formation 10 through the line 30, a diluent such as nitrogen or another inert gas can be introduced into the line 30 via the line 38. Such flexibility enables the adjustment of the amount of methane passed to the synthesis gas generator 32 to produce the desired quantity of synthesis gas. The stream in line 40 may be water, water vapor, air, oxygen-enriched air or the like, as desired. Desirably, air is used since it is desired to produce a substantial quantity of tail gas for injection into the coal formation 10. The production of oxygen-enriched air is expensive and unnecessary in the process of the present invention. As previously stated, the tail gas includes nitrogen, possibly other inert gases, light hydrocarbons containing less than three carbon atoms, carbon dioxide and, in many instances, limited quantities of carbon monoxide, hydrogen and water vapor. These materials are all desirable materials for injection into the coal formation 10 to increase the production of methane.

In the event that nitrogen, carbon dioxide or other gases begin to be recovered through the production well 24 and the line 30, make-up methane can be added to the line 38 as necessary to produce the desired quantity of synthesis gas and maintain the desired quantity of tail gas. Alternatively, a quantity of the gas in line 30 can be withdrawn through line 60 for processing to produce methane for sales. The oxygen-containing gas in line 40 may include added quantities of water or may be oxygen enriched if substantial quantities of inert gas are being recovered through the line 30. In the event that quantities of tail gas in excess of that desired for injection are produced, the excess tail gas can be removed, treated and passed to disposal through a line 62. This gas may require incineration or other treatment as known to those skilled in the art prior to venting it to the atmosphere.

As well known to those skilled in the art, Fischer-Tropsch processes can be adjusted to produce heavier hydrocarbons ranging from light gases such as olefins to liquids such as gasoline, lubricating oils or heavier liquids. Preferably, the heavier hydrocarbons are liquids at a temperature of 70° F. at one atmosphere.

The methane for use in the Fischer-Tropsch process may also be obtained by a huff and puff process. In such processes, a gas stream such as the gas stream described above is injected into a coal formation through a single well for a period of time, the well is then shut-in for a period of time and thereafter methane is produced from the well for a period of time. The sequence of operations is then repeated. Such huff and puff processes are useful to supply methane for the Fischer-Tropsch process, as described above, when a number of huff and puff wells are in operation or in conjunction with other methane recovery processes using injection and production wells.

When only huff and puff process wells are used methane is supplied from at least one well in production and the produced tail gases are injected into at least one well being injected. The wells are switched periodically to supply methane to the Fischer-Tropsch process and to accept the produced tail gas.

The methane may be produced from at least one first producing well with injection into at least one second injection well while the wells are in the production and injection portions of their respective cycles, with production being switched to other wells entering the producing portion of their cycle as the first producing wells are switched to become injection wells, as known to those skilled in the art.

According to the present invention, a valuable hydrocarbon product is produced while simultaneously producing a tail gas stream which is ideally suited for use as an injection gas for injection into the coal formation 10. Further, the present invention provides a process wherein methane or carbon dioxide contaminated methane is passed to a process where the gas is readily used in the contaminated form. Desirably, the mixture of gases charged to the synthesis gas generator 32 through the line 30 comprises at least 50% methane. The remaining 50% of the charged gas can be carbon dioxide, nitrogen or mixtures thereof. This process permits the use of methane mixed with other gases without the use of the expensive purification processes necessary to convert the methane to a substantially pure form for marketing as methane. The methane is used to produce a more valuable product without the necessity for purification. The process for producing the more valuable product is also effective to produce the desired tail gas when the charged methane is mixed with diluent gases.

The process equipment required to conduct the hydrocarbon synthesis process may be used to treat methane from coal formations which extend over a wide area. It may also be used to treat methane produced from coal seams which may lie at various depths and which may overlie or underlie each other. Since such coal formations tend to produce methane for many years, the construction of such a plant is not only feasible but is economically attractive since it produces a valuable liquid hydrocarbon product which can be transported as a liquid rather than a gaseous product.

In summary, the present invention provides a method for increasing the production of methane from a subterranean coal formation by a process which produces a valuable liquid hydrocarbon product and simultaneously generates as a by-product a desirable tail gas stream for compression, and optional heating, and reinjection into the coal formation to increase the production of methane from the coal formation. The component parts of the process synergistically cooperate to produce a product of increased value and a desired injection gas stream while permitting flexibility in the reactant quality required for the synthesis gas generation. This process is ideally adapted to the recovery of hydrocarbon values from coal formations containing methane in a highly efficient and highly effective manner.

Having described the present invention by reference to certain of its preferred embodiments, it is respectfully pointed out that the embodiments described are illustrative rather than limiting in nature and that many variations and modifications are possible within the scope of the present invention. Such variations and modifications may appear obvious and desirable to those skilled in the art based upon a review of the foregoing description of preferred embodiments.

Having thus described the invention, I claim:

1. A method for increasing the production of methane from a subterranean coal formation penetrated by at least one injection well and at least one production well, the method comprising:

producing methane from the coal formation through at least one production well;

passing at least a portion of the methane to a synthesis gas generation zone wherein at least a major portion of the methane is reacted with an oxygen containing gas to produce a mixture of carbon monoxide and hydrogen;

passing the mixture to a hydrocarbon synthesis zone wherein at least a major portion of the carbon monoxide and hydrogen are reacted to produce a heavier mixture of hydrocarbons containing more than one carbon atom per molecule and a tail gas comprising nitrogen and carbon dioxide;

separating at least a major portion of the tail gas from at least a major portion of the hydrocarbons and recovering the hydrocarbons as a product stream;

compressing at least a portion of the tail gas to a pressure suitable for injection into the coal formation; and injecting at least a portion of the tail gas into the coal formation through at least one injection well.

2. The method of claim 1 wherein the tail gas contains minor quantities of materials selected from the group consisting of carbon monoxide, water, hydrocarbons containing less than about 3 carbon atoms and mixtures thereof.

3. The method of claim 1 wherein the tail gas injected into the coal formation is compressed to a selected pressure prior to injection into the coal formation.

4. The method of claim 1 herein the tail gas injected into the coal formation is heated to a selected temperature prior to injection into the coal formation.

5. The method of claim 1 wherein said synthesis gas generation zone comprises an autothermal reformer.

6. The method of claim 5 wherein the oxygen containing gas is selected from the group consisting of air, oxygen enriched air, water, steam and combinations thereof.

7. The method of claim 1 wherein said synthesis gas generation zone comprises a steam reforming zone.

8. The method of claim 1 wherein said methane is desulfurized in a desulfurization zone prior to passing the methane to the synthesis gas generation zone.

9. The method of claim 1 wherein the reaction of the carbon monoxide and hydrogen in the hydrocarbon synthesis zone produces hydrocarbons which are liquids at temperatures below about 70° F. at one atmosphere pressure.

10. The method of claim 9 wherein the hydrocarbon synthesis reaction zone is a Fischer-Tropsch reaction zone.

11. The method of claim 10 wherein the hydrocarbons are separated from the mixture of hydrocarbons and tail gas by cooling the mixture to a selected temperature.

12. The method of claim 1 wherein the methane passed to the synthesis gas zone is passed to the synthesis gas zone in a mixture of gases selected from the group consisting of methane, nitrogen, carbon dioxide and mixtures thereof.

13. The method of claim 12 wherein the mixture of gases comprises at least fifty volume percent methane.

14. The method of claim 1 wherein the ratio of hydrogen to carbon monoxide in the mixture of carbon monoxide and hydrogen is from about 1.5 to about 3.0.

15. The method of claim 1 wherein the hydrocarbon synthesis zone comprises a hydrocarbon synthesis process wherein methanol is produced as a product or as a reactant for a heavier hydrocarbon synthesis step.

16. The method of claim 1 wherein said hydrocarbons are liquids at a temperature of 70° F. at one atmosphere.

17. A method for increasing the production of methane from a subterranean coal formation penetrated by a plurality of huff and puff process injection/production wells, the method comprising;

producing methane from at least one huff and puff well;

passing at least a portion of the methane to a synthesis gas generation zone wherein at least a major portion of the methane is reacted with an oxygen-containing gas to produce a mixture of carbon monoxide and hydrogen;

passing the mixture to a hydrocarbon synthesis zone wherein at least a major portion of the carbon monoxide and hydrogen are reacted to produce a heavier mixture of hydrocarbons containing more than one carbon atom per molecule and a tail gas comprising nitrogen and carbon dioxide;

separating at least a major portion of the tail gas from at least a major portion of the hydrocarbons and recovering the hydrocarbons as a product stream;

compressing at least a portion of the tail gas to a pressure suitable for injection into the coal formation; and injecting at least a portion of the tail gas into at least one huff and puff well.

18. The method of claim 17 wherein the tail gas contains minor quantities of materials selected from the group consisting of carbon monoxide, water, hydrocarbons containing less than 1 to about 3 carbon atoms and mixtures thereof.

19. The method of claim 17 herein the tail gas injected into the coal formation is heated to a selected temperature prior to injection into the coal formation.

* * * * *